US006132912A

United States Patent [19]

Fuller et al.

[11] Patent Number: 6,132,912

[45] Date of Patent: Oct. 17, 2000

[54] PHOTOCONDUCTIVE IMAGING MEMBERS

[75] Inventors: Timothy J. Fuller, Pittsford; Damodar M. Pai, Fairport; John F. Yanus, Webster; Markus R. Silvestri, Fairport; Huoy-Jen Yuh, Pittsford; John S. Chambers, Rochester; Harold F. Hammond, Webster; Susan M. Vandusen, Williamson; Dennis J. Prosser, Walworth; Kathleen M. Carmichael, Williamson; Robert C. U. Yu, Webster; Neil S. Patterson, Pittsford, all of N.Y.

[73] Assignee: Xerox Corporation, Stamford, Conn.

[21] Appl. No.: 09/320,869

[22] Filed: May 27, 1999

[51] Int. Cl.[7] ..... G03G 5/14

[52] U.S. Cl. ..... 430/58.8; 430/64

[58] Field of Search ..... 430/64, 60, 96, 430/58.8

[56] References Cited

U.S. PATENT DOCUMENTS

| | | | |
|---|---|---|---|
| 4,265,990 | 5/1981 | Stolka et al. | 430/59 |
| 4,464,450 | 8/1984 | Teuscher | 430/59 |
| 4,555,463 | 11/1985 | Hor et al. | 430/59 |
| 4,587,189 | 5/1986 | Hor et al. | 430/59 |
| 4,921,769 | 5/1990 | Yuh et al. | 430/64 |
| 4,921,773 | 5/1990 | Melnyk et al. | 430/132 |
| 5,308,725 | 5/1994 | Yu et al. | 430/56 |
| 5,385,796 | 1/1995 | Spiewak et al. | 430/64 |
| 5,449,573 | 9/1995 | Aoki et al. | 430/131 |
| 5,473,064 | 12/1995 | Mayo et al. | 540/141 |
| 5,482,811 | 1/1996 | Keoshkerian et al. | 430/135 |
| 5,493,016 | 2/1996 | Burt et al. | 540/139 |
| 5,645,965 | 7/1997 | Duff et al. | 430/59 |
| 5,688,621 | 11/1997 | Takegawa et al. | 430/64 |
| 5,814,426 | 9/1998 | Fuller et al. | 430/96 |
| 5,871,877 | 2/1999 | Ong et al. | 430/59 |
| 5,874,193 | 2/1999 | Liu et al. | 430/59 |

OTHER PUBLICATIONS

Chemical Abstracts 128:237208., 1998.

Grant and Hackh's Chemical Dictionary. New York: McGraw–Hill, Inc. p. 373., 1987.

*Primary Examiner*—Christopher D. Rodee

*Attorney, Agent, or Firm*—E. O. Palazzo

[57] ABSTRACT

A photoconductive imaging member comprised of a supporting substrate, a layer (1) thereover, a photogenerating layer and a charge transport layer, and wherein said layer (1) is generated from a mixture of a polyhydroxyalkylacrylate, and an amino alkyltrialkoxysilane.

38 Claims, No Drawings

PHOTOCONDUCTIVE IMAGING MEMBERS

RELATED PATENTS

Disclosed in U.S. Pat. No. 5,645,965, the disclosure of which is totally incorporated herein by reference, are photoconductive imaging members with perylenes and a number of charge transports, such as amines.

Illustrated in U.S. Pat. No. 5,874,193, the disclosure of which is totally incorporated herein by reference, are photoconductive imaging members, with a hole blocking layer comprised of a crosslinked polymer derived from crosslinking a alkoxysilyl-functionalized polymer bearing an electron transporting moiety. In U.S. Pat. No. 5,871,877, the disclosure of which is totally incorporated herein by reference, there are illustrated multilayered imaging members with a solvent resistant hole blocking layer comprised of a crosslinked electron transport polymer derived from crosslinking a thermally crosslinkable alkoxysilyl, acryloxysilyl or halosilyl-functionalized electron transport polymer with an alkoxysilyl, acryloxysilyl or halosilyl compound such as an alkyltrialkoxysilane, alkyltrihalosilane, alkylacryloxysilane, aminoalkyltrialkoxysilane, and the like, and preferably in contact with the supporting substrate and situated between the supporting substrate and the photogenerating layer, and which photogenerating layer may be comprised of the photogenerating pigments of U.S. Pat. No. 5,482,811, the disclosure of which is totally incorporated herein by reference, especially Type V hydroxygallium phthalocyanine.

Illustrated in U.S. Pat. No. 5,493,016, the disclosure of which is totally incorporated herein by reference, are imaging members comprised of a supporting substrate, a photogenerating layer of hydroxygallium phthalocyanine, a charge transport layer, a photogenerating layer of BZP perylene, which is preferably a mixture of bisbenzimidazo (2,1-a-1',2'-b)anthra(2,1,9-def:6,5,10-d'e'f')diisoquinoline-6, 11-dione and bisbenzimidazo(2,1-a:2',1'-a)anthra(2,1,9-def:6,5,10-d'e'f')diisoquinoline-10,21-dione, reference U.S. Pat. No. 4,587,189, the disclosure of which is totally incorporated herein by reference; and as a top layer a second charge transport layer.

Also, in U.S. Pat. No. 5,473,064, the disclosure of which is totally incorporated herein by reference, there is illustrated a process for the preparation of hydroxygallium phthalocyanine Type V, essentially free of chlorine, whereby a pigment precursor Type I chlorogallium phthalocyanine is prepared by the reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts of $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

The appropriate components and processes of the above patents, inclusive for example of the photogenerating components or pigments, the charge components, and the supporting substrate, may be selected for the present invention in embodiments thereof.

BACKGROUND OF THE INVENTION

This invention is generally directed to imaging members, and, more specifically, the present invention is directed to multilayered photoconductive imaging members with a solvent resistant hole blocking and electron transporting and/or partially conducting layer comprised of a thick film, for example, from about 0.05 to about 5 and preferably from about 1 to about 3 microns of a component obtained from a solution of a hydroxy containing polymer, copolymer, terpolymer, or mixtures thereof of, for example, polyhydroxyalkyl acrylate or polyhydroxyalkyl methacrylate, and more specifically poly(2-hydroxyethyl acrylate), poly(2-hydroxyethyl methacrylate), poly(3-hydroxypropyl acrylate), poly(4-hydroxybutyl acrylate), and the like, and an aminoalkylalkoxysilane, such as 3- or gamma-aminoalkyltrialkyloxysilane. This layer or film is easily coatable, thus print defects can be eliminated or minimized; is substantially free of dielectric breakdown in bias charging roll development systems, as compared, for example, to a single layer of gamma-aminopropyltrimethoxysilanes, and which silanes are difficult to coat uniformly as thin films, thus causing print defects, are susceptible to dielectric breakdown with bias roll development systems, and wherein any uncured silane contaminates the photogenerating layer and thereby changes the photoconductor device photosensitivity and adversely affects the cyclic stability in different atmospheres. Additionally, the gamma silane is susceptible to cracking primarily because of the high crosslink density thereof, which disadvantages can be avoided or minimized with the photoconductive members of the present invention. Moreover, thin silane layers (less than 500 Angstroms) may leave unwetted areas during the coating process. Thick undercoat layers of, for example, from about 1 to about 10 microns provide for improved coating uniformity, and the use of inexpensive substrates because substrate defects can be covered up (or masked), resulting in improved print quality as substrate defects are not printed out in the developed copies produced. Moreover, a thick undercoat layer as compared to a thin, less than 500 Angstroms, for example from about 200 to about 400 Angstroms, enables better electrical properties by preventing or minimizing the injection of holes into the photogenerator layer while allowing electron transport from the photogenerator layer to the ground plane after light exposure. Whether thick or thin, it is important that the undercoat possesses environmental insensitivity to changes in temperature and relative humidity; enables low residual voltages and dark decay voltages, and allows cyclic stability for more than 100,000 cycles. The undercoating layer is preferably in contact with the supporting substrate and is preferably situated between the supporting substrate and the photogenerating layer, and which layer may be comprised of the photogenerating pigments of U.S. Pat. No. 5,482,811, the disclosure of which is totally incorporated herein by reference, especially Type V hydroxygallium phthalocyanine, halogallium phthalocyanine, dimers generated from the reaction of HOGaPc and ClGaPc, bisimidazoleperylene, trigonal selenium, metal free x-phthalocyanine and metal containing phthalocyanines, such as vanadyl phthalocyanine, mixtures thereof, and the like.

The imaging members of the present invention in embodiments exhibit excellent cyclic/environmental stability, independent layer discharge, and substantially no adverse changes in performance over extended cyclic time periods, and wherein the imaging members, such as photoconductive members, also possess solvent resistant blocking layers, and enable suitable hole blocking layer thickness that can be easily coated on the supporting substrate by various coating techniques of, for example, dip or slot-coating. The aforementioned photoresponsive, or photoconductive imaging members can be negatively charged when the photogenerating layer is situated between the hole transport layer and the blocking layer deposited on the substrate. The invention imaging members are in embodiments sensitive in the wavelength region of, for example, from about 550 to about 900 nanometers, and in particular, from about 650 to about 850 nanometers, thus diode lasers can be selected as the light source.

Processes of imaging, especially xerographic imaging and printing, including digital, are also encompassed by the present invention. More specifically, the layered photoconductive imaging members of the present invention can be selected for a number of different known imaging and printing processes including, for example, multifunctional imaging/facsimile devices electrophotographic imaging processes, especially xerographic imaging and printing processes wherein charged latent images are rendered visible with toner compositions of an appropriate charge polarity. Moreover, the imaging members of the present invention are preferably useful in color xerographic applications where several color printings can be achieved in a single pass.

PRIOR ART

Layered photoresponsive imaging members have been described in a number of U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of disclosed photogenerating layer components include trigonal selenium, metal phthalocyanines, vanadyl phthalocyanines, and metal free phthalocyanines. Additionally, there is described in U.S. Pat. No. 3,121,006 a composite xerographic photoconductive member comprised of finely divided particles of a photoconductive inorganic compound dispersed in an electrically insulating organic resin binder. The binder materials disclosed in the '006 patent comprise a material which is substantially incapable of transporting for any significant distance injected charge carriers generated by the photoconductive particles.

The use of perylene pigments as photoconductive substances is also known. There is thus described in Hoechst European Patent Publication 0040402, DE3019326, filed May 21, 1980, the use of N,N'-disubstituted perylene-3,4,9,10-tetracarboxyldiimide pigments as photoconductive substances. Specifically, there is, for example, disclosed in this publication N,N'-bis(3-methoxypropyl)perylene-3,4,9,10-tetracarboxyldiimide dual layered negatively charged photoreceptors with improved spectral response in the wavelength region of 400 to 700 nanometers. A similar disclosure is presented in Ernst Gunther Schlosser, *Journal of Applied Photographic Engineering,* Vol. 4, No. 3, page 118 (1978). There are also disclosed in U.S. Pat. No. 3,871,882 photoconductive layers comprised of specific perylene-3,4,9,10-tetracarboxylic acid derivative dyestuffs. In accordance with this patent, the photoconductive layer is preferably formed by vapor depositing the dyestuff in a vacuum. Also, there are disclosed in this patent dual layer photoreceptors with perylene-3,4,9,10-tetracarboxylic acid diimide derivatives, which have spectral response in the wavelength region of from about 400 to about 600 nanometers.

Illustrated in U.S. Pat. No. 4,555,463, the disclosure of which is totally incorporated herein by reference, is a layered imaging member with a chloroindium phthalocyanine photogenerating layer. In U.S. Pat. No. 4,587,189, the disclosure of which is totally incorporated herein by reference, there is illustrated a layered imaging member with, for example, a BZP perylene pigment photogenerating component. Both of the aforementioned patents disclose an aryl amine component, such as N,N'-diphenyl-N,N'-bis(3-methyl phenyl)-1,1'-biphenyl-4,4'-diamine dispersed in a polycarbonate binder, as a hole transport layer. The above components, such as the photogenerating compounds and the aryl amine charge transport can be selected for the imaging members of the present invention.

In U.S. Pat. No. 4,921,769, the disclosure of which is totally incorporated herein by reference there is illustrated photoconductive imaging members with blocking layers of certain polyurethanes.

There is disclosed in U.S. Pat. No. 4,464,450, the disclosure of which is totally incorporated herein by reference, developed thin coatings of gamma-aminopropyltriethoxysilane hydrolyzed with acetic acid to prevent low relative humidity cycle down in trigonal selenium photoreceptors.

Illustrated in U.S. Pat. No. 5,449,573, the disclosure of which is totally incorporated herein by reference, are undercoat layers containing gamma-aminopropyltriethoxysilane (6.2 parts), tributoxyzirconium acetylacetonate (45.8 parts) and polyvinylbutyral (BMS, 3.2 parts) in 1-butanol (59.8 parts) as the solvent. This three component undercoat layer usually requires humidification during the drying step and the dried layer thickness is limited from a practical perspective to, for example, about 1.5 microns for optimum performance. In U.S. Pat. No. 5,385,796, the disclosure of which is totally incorporated herein by reference, poly(2-hydroxyethyl methacrylate) is disclosed for use in imaging members, and which members possess high dark decay and cyclic instability, disadvantages avoided or minimized with the members of the present invention.

SUMMARY OF THE INVENTION

It is a feature of the present invention to provide imaging members thereof with many of the advantages illustrated herein such as a more rapid curing, for example about equal to, or less than about one minute, for example, from about 5 to about 50 seconds, of the undercoat or hole blocking layer, and which layer prevents, or minimizes dark injection, and wherein the resulting photoconducting members possess for example, excellent PIDCs (photoinducted charge discharge curves), cyclic stability, environmental stability and acceptable low charge deficient spots (CDS). Charge deficient spots (CDS) in discharge area development (DAD) appear as black spots on white background areas of the print. CDS black spots are especially visible at 80° F. and 80 percent relative humidity.

Another feature of the present invention relates to the provision of improved layered photoresponsive imaging members with photosensitivity to near infrared radiations.

It is yet another feature of the present invention to provide improved layered photoresponsive imaging members with a sensitivity to visible light, and which members possess improved coating characteristics and wherein the charge transport molecules do not diffuse, or there is minimum diffusion thereof into the photogenerating layer.

Moreover, another feature of the present invention relates to the provision of layered photoresponsive imaging members with durable, and solvent resistant, thick, for example, from about 1 to about 5 microns, hole blocking layers.

In a further feature of the present invention there are provided imaging members containing photogenerating pigments of, for example, Type V hydroxygallium phthalocyanine, trigonal selenium, chlorogallium phthalocyanine, hydroxygallium phthalocyanine, dimers thereof, bisimidazole perylenes, and the like.

Aspects of the present invention relate to a photoconductive imaging member comprised of a supporting substrate, a layer (1) thereover, a photogenerating layer and a charge transport layer, and wherein the layer (1) is generated from a mixture of a polyhydroxyalkylacrylate, and an amino alkyltrialkoxysilane; a photoconductive imaging member wherein alkyl (for the acrylate and/or silane) contains from about 1 to about 25 carbon atoms; a photoconductive imaging member wherein alkyl contains from about 1 to about 4 carbon atoms; a photoconductive imaging member wherein alkyl contains from about 1 to about 10 carbon atoms; a photoconductive imaging member wherein alkoxy contains from about 1 to about 25 carbon atoms; a photoconductive imaging member wherein alkoxy contains from about 1 to about 12 carbon atoms; a photoconductive imaging member wherein the acrylate is poly(2-hydroxyethylacrylate) poly(2-hydroxyethyl methacrylate), poly(3-hydroxypropyl acrylate), poly(3-hydroxypropyl methacrylate), poly(4-hydroxybutyl acrylate), or poly(4-hydroxybutyl methacrylate); a photoconductive imaging member wherein the acrylate is a homopolymer, a copolymer, a terpolymer, or mixtures thereof; a photoconductive imaging member wherein the molecular weight $M_n$ of the acrylate is from about 5,000 to about 100,000, and the polydispersity is from about 1 to about 10; a photoconductive imaging member wherein the silane is an aminopropyltrimethoxysilane; a photoconductive imaging member wherein the silane is gamma-aminopropyltriethoxysilane; a photoconductive imaging member wherein the mixture contains from about 1 to about 99 percent by weight of the polyhydroxyalkylacrylate, and from about 99 to about 1 weight percent of the amino alkyltrialkoxysilane, and wherein the total of the two components is about 100 percent; a photoconductive imaging member wherein the mixture contains from about 25 to about 75 percent by weight of a polyhydroxyalkylacrylate, and from about 25 to about 75 weight percent of an amino alkyltrialkoxysilane, and wherein the total of the two components is about 100 percent; a photoconductive imaging member wherein there is selected as the alkylalkoxysilane an organosilane selected from the group consisting of methyltrichlorosilane, dimethyldichlorosilane, methyltrimethoxysilane, methyltriethoxysilane, ethyltrichlorosilane, ethyltrimethoxysilane, dimethyldimethoxysilane, methyltriethoxysilane, ethyltriethoxysilane, and propyltrimethoxysilane; a photoconductive imaging member wherein the layer (1) is of a thickness of from about 1 to about 5 microns; a photoconductive imaging member wherein the layer (1) is of a thickness of from about 1 to about 3 microns; a photoconductive imaging member comprised in the following sequence of a supporting substrate, the layer (1) functioning as an undercoat layer, an adhesive layer, a photogenerating layer and a charge transport layer; a photoconductive imaging member further containing an adhesive layer comprised of a polyester with an $M_w$ of about 70,000, and an $M_n$ of about 35,000; a photoconductive imaging member wherein the supporting substrate is comprised of a conductive metal substrate; a photoconductive imaging member wherein the substrate is aluminum, polyethylene terephthalate or titanized polyethylene terephthalate; a photoconductive imaging member wherein the photogenerator layer is of a thickness of from about 0.05 to about 10 microns; a photoconductive imaging member wherein the transport layer is of a thickness of from about 10 to about 50 microns; a photoconductive imaging member wherein the photogenerating layer is comprised of photogenerating pigments dispersed in a resinous binder, and which pigments are selected in an amount of from about 5 percent by weight to about 95 percent by weight; a photoconductive imaging member wherein the resinous binder is selected from the group consisting of polyesters, polyvinyl butyrals, polycarbonates, polystyrene-b-polyvinyl pyridine, and polyvinyl formals; a photoconductive imaging member wherein the charge transport layer comprises aryl amine molecules; a photoconductive imaging member wherein there are selected as the charge transport aryl amines of the formula

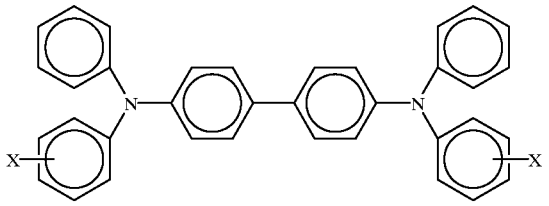

wherein X is selected from the group consisting of alkyl and halogen, and wherein the aryl amine is optionally dispersed in a highly insulating and transparent resinous binder; a photoconductive imaging member wherein alkyl for the components of (1) is methyl, wherein halogen is chloride, and wherein the resinous binder is selected from the group consisting of polycarbonates, polyarylene ether ketones, and polystyrenes; a photoconductive imaging member wherein the aryl amine is N,N'-diphenyl-N,N-bis(3-methyl phenyl)-1,1'-biphenyl-4,4'-diamine; a photoconductive imaging member further including an adhesive layer of a polyester with an $M_w$ of about 70,000, and an $M_n$ of about 35,000; a photoconductive imaging member wherein the photogenerating layer is comprised of metal phthalocyanines, or metal free phthalocyanines; a photoconductive imaging member wherein the photogenerating layer is comprised of titanyl phthalocyanines, perylenes, hydroxygallium phthalocyanines, trigonal selenium, chlorogallium phthalocyanine, mixtures of chlorogallium phthalocyanine and hydroxygallium phthalocyanine and dimers thereof; a photoconductive imaging member wherein the photogenerating layer is comprised of Type V hydroxygallium phthalocyanine; a method of imaging which comprises generating an electrostatic latent image on the imaging member of the present invention, developing the latent image, and transferring the developed electrostatic image to a suitable substrate; a photoconductive imaging member comprised of a mixture of a polyhydroxy alkylacrylate and an alkyltrialkyloxysilane; a photoconductive imaging member wherein the member contains a substrate, a photogenerating layer, and a charge transport layer; a photoconductive imaging member wherein the mixture (1) is present as a layer on the substrate; a photoconductive imaging member wherein the alkyltrialkoxysilane is an aminotrialkoxysilane; a photoconductive imaging member wherein the alkyltrialkoxysilane is an organosilane selected from the group consisting of methyltrichlorosilane, dimethyldichlorosilane, methyltrimethoxysilane, methyltriethoxysilane, ethyltrichlorosilane, ethyltrimethoxysilane, dimethyldimethoxysilane, ethyltriethoxysilane, and propyltrimethoxysilane; a photoconductive imaging member wherein the mixture (1) results from the reaction of the acrylate and the alkoxysilane; a photoconductive imaging member comprised of a supporting substrate, a hole blocking layer thereover, an optional adhesive or interfacial layer, a photogenerating layer and a charge transport layer, and wherein the hole blocking layer is comprised of a compound generated from a mixture of a poly(hydroxyalkylacrylate), such as poly(2-hydroxyethyl acrylate), poly(2-hydroxyethyl methacrylate), poly(3-hydroxypropyl acrylate), poly(3-hydroxypropyl methacrylate), poly(4-hydroxybutyl acrylate), poly(4-hydroxybutyl methacrylate), homopolymers, copolymers, terpolymers, or mixtures thereof, and an aminoalkyltrialkoxysilane, and wherein alkyl and alkoxy contain, for example, from about 1 to about 25 carbon atoms and preferably from about 1 to about 7 carbon atoms; a photoconductive imaging member comprised in the following sequence of a supporting substrate, a hole blocking layer, an adhesive layer, a photogenerating layer and a charge transport layer; a photoconductive imaging member wherein the adhesive layer is comprised of a polyester with an $M_w$ of from about 50,000 to about 100,000, and preferably about 70,000, and an $M_n$ of preferably about 35,000; a photoconductive imaging member wherein the supporting substrate is comprised of a conductive metal substrate; a photoconductive imaging member wherein the conductive substrate is aluminum, aluminized polyethylene terephthalate or titanized MYLAR®; a photoconductive imaging member wherein the photogenerator layer is of a thickness of from about 0.05 to about 10 microns; a photoconductive imaging member wherein the charge transport layer is of a thickness of from about 10 to about 50 microns; a photoconductive imaging member wherein the photogenerating layer is comprised of photogenerating pigments dispersed in a resinous binder in an amount of from about 5 percent by weight to about 95 percent by weight; a photoconductive imaging member wherein the resinous binder is selected from the group consisting of polyesters, polyvinyl butyrals, polycarbonates, polystyrene-b-polyvinyl pyridine, and polyvinyl formals; a photoconductive imaging member wherein the charge transport layer comprises aryl amine molecules; a photoconductive imaging member wherein the aryl amines are coated as a layer on the mixture (1) and are of the formula

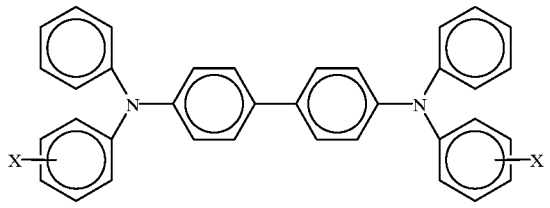

wherein X is selected from the group consisting of alkyl and halogen, and wherein the aryl amine is preferably dispersed in a highly insulating and transparent resinous binder; a photoconductive imaging member wherein the arylamine alkyl contains from about 1 to about 10 carbon atoms; a photoconductive imaging member wherein the arylamine alkyl contains from 1 to about 5 carbon atoms; a photoconductive imaging member wherein the arylamine alkyl is methyl, wherein halogen is chlorine or chloride, and wherein the resinous binder is selected from the group consisting of polycarbonates, polyarylene ether ketones, reference U.S. Pat. No. 5,184,426, the disclosure of which is totally incorporated herein by reference, and polystyrenes; a photoconductive imaging member wherein the aryl amine is N,N'-diphenyl-N,N-bis(3-methyl phenyl)-1,1'-biphenyl-4,4'-diamine; a photoconductive imaging member further including in contact with the supporting substrate an adhesive layer of a polyester with an $M_w$ of preferably from about 50,000 to about 70,000, and an $M_n$ of from about 25,000 to about 50,000, and preferably about 35,000; a photoconductive imaging member wherein the photogenerating layer is comprised of metal phthalocyanines, or metal free phthalocyanines, such as vanadyl phthalocyanine; wherein the photogenerating layer contains trigonal selenium, chlorogallium phthalocyanine, and/or dimers and mixtures of hydroxygallium phthalocyanines and dimers thereof; a photoconductive imaging member wherein the photogenerating layer is comprised of titanyl phthalocyanines, perylenes, or hydroxygallium phthalocyanines; a photoconductive imaging member wherein the photogenerating layer is comprised of Type V hydroxygallium phthalocyanine; and a method of imaging which comprises generating an electrostatic latent image on an imaging member, developing the latent image, transferring the developed electrostatic image to a suitable substrate, and fixing the image by heat. More specifically, the hole blocking layer, which can also function as an electron transport layer is in contact with the supporting substrate of the photoconductive member and which layer contains hydroxy containing polymers, and an alkyltrialkyl oxysilane.

Examples of hydroxy acrylate containing polymers include poly(2-hydroxyethyl acrylate), poly(2-hydroxyethyl methacrylate), poly(3-hydroxypropyl acrylate), poly(3-hydroxypropyl methacrylate), poly(4-hydroxybutyl acrylate), poly(4-hydroxybutyl methacrylate), homopolymers, copolymers, terpolymers, mixtures thereof, and the like, and which polymers are available from Scientific Polymer Products, Ontario, N.Y., and which polymers can be typically prepared by the free radical polymerization of the corresponding monomer in various solvents principally alcohol or water at from about 50° C. to about 70° C., with 60° C. preferred, and at an amount of solvent that is about 60 percent, and more specifically, at 9:1 vol/vol solvent to monomer concentration using a free radical initiator such azobisisobutyronitrile initiator. The polymers can be considered atactic but syndiotactic and isotactic materials can also be selected. Representative references for the polymerizations are as follows: M. Macret and Gerald Hild, "Hydroxyalkyl methacrylates: kinetic investigations of radical polymerizations of pure 2-hydroxy methacrylate and 2,3-dihydroxypropyl methacrylate and the radical copolymerization of their mixtures", *Polymer,* 1982, 23, 81, and ibid, 748; O. Wichterle and R. J. Chromecek, *J. Polym. Sci.,* 1969, C16, 4677; R. J. Fort and T. M. Polyzoidis, *Eur. Polym. J.,* 1976, 12, 685; B. Carton, V. Bottiglione, M. Morcellet, and C. Loucheux, *Makromol. Chem.,* 1978, 179, 2931; D. E. Gregonis, G. A. Russell, J. D. Andrade, and A. C. deVisser, "Preparation and properties of stereoregular poly(hydroxyethylmethacrylate) polymers and hydrogels," Polymer, 1978, 19, 1279; and D. E. Gregonis, C. M. Chen, and J. D. Andrade, in "Hydrogels for Medical and Related Applications," ACS Symposium Series No. 31, Washington, D.C., 1976, p. 88, the disclosures of each of these publications being totally incorporated herein by reference.

The hydroxy-containing polymer at about 20 percent (weight percent throughout) solids in an alcohol like methanol, ethanol, propanol or butanol is combined with a suitable amount of, for example, from about 0.1 to about 3 equivalents of an amino silane, such as gamma-aminopropyltriethoxy or trimethoxy silane, preferably about 50 weight percent based on resin solids, and then optionally acetic acid and/or water can be added. The resulting solution is allowed to stir for a suitable time, for example about 16 hours, and the viscosity of the solution is adjusted by the addition of an alcohol solvent to, for example, about 20 centipoise as determined by Brookfield viscometer. Water may be added to redissolve any gel that forms when the alcohol is added. The solution resulting is then dip coated or applicator bar coated onto a suitable substrate, usually metallized (Zr/Ti) MYLAR® or aluminum cylinder substrates. Typically, a Bird applicator bar with a 1 mil gap is used to apply the coating solution which is then dried in an oven at 135° C., preferably for between about 1 and about 10 minutes. The thickness of the resultant layer is measured using a permascope, TCI Autotest model DS (Eddy/Mag) manufactured by Twin City International, Inc., North Tonawanda, N.Y. 14120. Typical undercoating coating thickness is from about 1 to about 5 microns. This layer is optionally overcoated with a 0.5 weight percent solids solution of 49,000 adhesive (DuPont de Nemours) applied with a 1 mil gap Bird applicator bar. This interfacial adhesive layer is typically dried for 3 minutes at 135° C. This adhesive layer is then overcoated with a binder photogenerator layer of, for example, trigonal selenium dispersed in poly(vinyl carbazole) with cyclohexanone, chlorogallium phthalocyanine dispersed in poly[vinylchloride-vinylacetate-maleic acid] {VMCH} or polyvinylbutyral with n-butylacetate or cyclohexanone, hydroxygallium phthalocyanine dispersed in either PCZ polycarbonate with tetrahydrofuran or polystyrene-block-polyvinylpyridine with toluene, or benzimidazole perylene dispersed in PCZ polycarbonate with tetrahydrofuran. The photogenerator layer is typically dried for five minutes at 135° C.

The next layer in contact with the photogenerating layer is the charge transfer layer prepared by dissolving 1 part TBD [N,N'-diphenyl-N,N-bis(3-methyl phenyl)-1,1'-biphenyl-4,4'-diamine] and 1 part MAKROLON® polycarbonate in 11.3 parts methylene chloride. The resulting solution is applied with an 8 mil gap Bird applicator bar and the resultant film is then ramp dried from about 40° C. to about 100° C. over 30 minutes. The dried transport layer is about 25 microns in thickness. The resultant photoresponsive imaging members are then tested in a cyclic xerographic test scanner. More specifically, each prepared photoreceptor device was mounted on a cylindrical aluminum drum substrate which was rotated on a shaft of a scanner, and charged by a corotron mounted along the periphery of the drum. The surface potential was measured as a function of time by capacitively coupled voltage probes placed at different locations around the shaft. The probes were calibrated by applying known potentials to the drum substrate. The photoreceptors on the drums were exposed by a light source located at a position near the drum downstream from the corotron. As the drum was rotated, the initial (pre-exposure) charging potential was measured by a voltage probe. Further rotation leads to the exposure station, where the photoreceptor was exposed to monochromatic radiation of a known intensity. The photoreceptor was erased by light source located at a position upstream of charging. The measurements made included charging of the photoreceptor in a constant current or voltage mode. The photoreceptor was corona charged to a negative polarity. As the drum was rotated, the initial charging potential was measured by a voltage probe. Further rotation leads to the exposure station, where the photoreceptor was exposed to monochromatic radiation of known intensity. The surface potential after exposure was measured by voltage at two other probes. The photoreceptor was finally exposed to an erase lamp of appropriate intensity and any residual potential was measured by voltage probe 4. The process was repeated with the magnitude of the exposure automatically changed during the next cycle. The photodischarge characteristics were obtained by plotting the potentials at the two other voltage probes as a function of light exposure. The charge acceptance and dark decay were also measured in a scanner. The initial slope of the discharge curve is termed S in units of (volts $cm^2$/ergs) and the residual potential after erase is termed $V_r$. The devices were cycled for 10,000 cycles in a continuous mode in B zone (20° C., 40 percent relative humidity, RH).

At least three different photoreceptor designs were investigated. In the first, the hydroxy containing polymer at 20 centipoise in ethanol was coated on a flexible titanized MYLAR® substrate, followed by the optional 49,000 adhesive layer, followed by the binder photogenerator layer, followed by the charge transport layer. In the second device, a layer of hydrolyzed gamma-aminotriethoxysilane, reference U.S. Pat. No. 4,464,450, was coated on top of the hydroxy containing polymer layer, followed by the optional interfacial adhesive layer, followed by the binder-photogenerator layer, and as the top layer the charge transport layer. The third photoreceptor design contained a mixture of a hydroxy containing polymer and gamma-aminopropyltriethoxysilane with optional acetic acid (0.3 gram of acetic acid per gram of gamma-aminopropyltriethoxysilane), followed by the optional interfacial 49,000 adhesive layer, followed by the binder-photogenerator layer, and then followed by the charge transport layer. From these experiments the following was determined. The polyhydroxy containing polymers appear satisfactory for 10,000 scans in the C zone (15° C., 10 percent relative humidity), but some cycle-up (increase of residual voltage after light erase with cycling) sometimes remained after 30,000 scans in the C zone. This effect was reversed at higher relative humidity and 25° C. The conclusion from this experiment is that water might be involved in the electron transport mechanism. In the absence of water at 0 percent relative humidity, oxidation of the alcohol groups may occur. When gamma-aminopropyltriethoxysilane is present in the mixture, this cycle-up did not appear to occur even at 0 percent relative humidity in 50,000 cycles. It is believed gamma-aminopropyltriethoxysilane either prevents oxidation of the hydroxy groups or chemically reduces the oxidized species back to hydroxyl groups. Gamma-aminopropyltriethoxysilane is desirable in the thick undercoat formulations. Moreover, the gamma-aminopropyl triethoxysilane promotes interlayer adhesion.

Examples of silanes selected are methyltrichlorosilane, dimethyldichlorosilane, methyltrimethoxysilane, methyltriethoxysilane, ethyltrichlorosilane, ethyltrimethoxysilane, dimethyldimethoxysilane, ethyltriethoxysilane, propyltrimethoxysilane, 3-aminopropyltrimethoxysilane, and 3-aminopropyltriethoxysilane; alkylhalosilanes, alkylalkoxysilanes, aminoalkylsilanes, and the like, and preferably 3-aminopropyl trimethoxysilane or 3-aminopropyltriethoxysilane.

Illustrative examples of substrate layers selected for the imaging members of the present invention can be opaque or substantially transparent, and may comprise any suitable material having the requisite mechanical properties. Thus, the substrate may comprise a layer of insulating material including inorganic or organic polymeric materials, such as MYLAR® (polyethylene terephthalate), a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and many have a number of many different configurations, such as for example a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as for example, polycarbonate materials commercially available as MAKROLON®.

The thickness of the substrate layer depends on many factors, including economic considerations, thus this layer may be of substantial thickness, for example over 3,000 microns, or of minimum thickness providing there are no adverse effects on the member. In one embodiment, the thickness of this layer is from about 75 microns to about 300 microns.

Optionally, the undercoat layer mixture may contain effective suitable amounts, for example, of from about 1 to about 10 weight percent, of conductive and nonconductive particles, such as zinc oxide, titanium dioxide, silicon nitride, tin oxide, carbon black, and the like, to provide, for example, in embodiments of the present invention further desirable electrical and optical properties.

As optional adhesives usually in contact with the undercoat layer or hole blocking layer, there can be selected various known substances inclusive of polyesters, polyamides, poly(vinyl butyral), poly(vinyl alcohol), polyurethane and polyacrylonitrile. This layer is, for example, of a thickness of from about 0.001 micron to about 3, or from about 0.1 to about 1 micron.

The photogenerating layer, which is preferably comprised of hydroxygallium phthalocyanine Type V, is in embodiments comprised of, for example, about 50 weight percent of the Type V and about 50 weight percent of a resin binder like a copolymer of polystyrene/polyvinylpyridine. The photogenerating layer can contain known photogenerating pigments, such as metal phthalocyanines, metal free phthalocyanines, especially x-metal free phthalocyanine, hydroxygallium phthalocyanines, chlorogallium phthalocyanine, mixtures of hydroxygallium phthalocyanine and chlorogallium phthalocyanine and dimers thereof, perylenes, especially bis(benzimidazo)perylene, titanyl phthalocyanines, and the like, and more specifically vanadyl phthalocyanines, Type V hydroxygallium phthalocyanines, and inorganic components such as selenium, especially trigonal selenium. The photogenerating pigment can be dispersed in a resin binder, similar to the resin binders selected for the charge transport layer, or alternatively no resin binder is selected. Illustrative examples of polymeric binder materials that can be selected for the photogenerator layer are as indicated herein, and include those polymers as disclosed in U.S. Pat. No. 3,121,006, the disclosure of which is totally incorporated herein by reference. More specifically, the photogenerating layer binder resin, present in various suitable amounts, for example from about 1 to about 50, and more specifically, from about 1 to about 10 weight percent, may be selected from a number of known polymers such as poly(vinyl butyral), poly(vinyl carbazole), polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like. In embodiments of the present invention, it is desirable to select a coating solvent that does not substantially disturb or adversely effect the other previously coated layers of the device. Examples of solvents that can be selected for use as coating solvents for the photogenerator layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

Generally, the thickness of the photogenerator layer depends on a number of factors, including the thicknesses of the other layers and the amount of photogenerator material contained in the photogenerating layers. Accordingly, this layer can be of a thickness of, for example, from about 0.05 micron to about 10 microns, and more specifically, from about 0.1 micron to about 2 micron when, for example, the photogenerator compositions are present in an amount of from about 30 to about 75 percent by volume. The maximum thickness of the layer in an embodiment is dependent primarily upon factors, such as photosensitivity, electrical properties and mechanical considerations.

The coating of the photogenerator layers in embodiments of the present invention can be accomplished with spray, dip or wire-bar methods such that the final dry thickness of the photogenerator layer is, for example, from about 0.05 to about 10 microns and preferably from about 0.1 to about 2 microns after being dried at, for example, about 40° C. to about 150° C. for about 15 to about 90 minutes.

Aryl amines selected as the charge, especially hole transporting layer, which generally is of a thickness of from about 5 microns to about 75 microns, and preferably of a thickness of from about 10 microns to about 50 microns, include molecules of the following formula

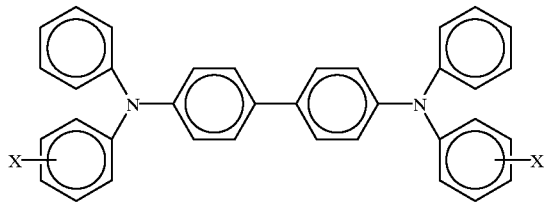

preferably dispersed in a highly insulating and transparent polymer binder, wherein X is an alkyl group, a halogen, or mixtures thereof, especially those substituents selected from the group consisting of Cl and $CH_3$.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other known charge transport layer molecules can be selected, reference for example U.S. Pat. Nos. 4,921,773 and 4,464,450, the disclosures of which are totally incorporated herein by reference.

Examples of the highly insulating and transparent polymer binder materials for the transport layer include components, such as those described in U.S. Pat. No. 3,121,006, the disclosure of which is totally incorporated herein by reference. Specific examples of polymer binder materials include polycarbonates, acrylate polymers, vinyl polymers, polyvinylcarbazole, polysilanes, cellulose polymers, polyesters, polysiloxanes, polyamides, polyurethanes and epoxies as well as block, random or alternating copolymers thereof. Preferred electrically inactive binders are comprised of polycarbonate resins having a molecular weight $M_w$ of from about 20,000 to about 100,000 with a molecular weight of from about 50,000 to about 100,000 being particularly preferred. Generally, the transport layer contains from about 10 to about 75 percent by weight of the charge transport material, and preferably from about 35 percent to about 50 percent of this material.

Also, included within the scope of the present invention are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the photoconductive member or device is to be used in a printing mode, the imaging method involves the same steps with the exception that the exposure step can be accomplished with a laser device or image bar.

The following Examples are being submitted to illustrate embodiments of the present invention. These Examples are intended to be illustrative only and are not intended to limit the scope of the present invention. Also, parts and percentages are by weight unless otherwise indicated. Comparative Examples and data are also provided.

EXAMPLE I

Control photoreceptor devices or photoconductive imaging members were prepared with hydrolyzed gamma-aminopropyltriethoxysilane (γ-APS) as the undercoat situated between a substrate and a photogenerating layer, reference U.S. Pat. No. 4,464,450, the disclosure of which is totally incorporated herein by reference. A coating solution was generated by adding gamma-aminopropyltriethoxysilane (γ-APS, 1 gram, obtained from Aldrich or Dow Corning) to deionized water (4 grams) and the solution was magnetically stirred for 4 hours. Glacial acetic acid (0.3 grams) was then added and stirring was continued for 10 minutes. Ethanol (74.7 grams) was then added followed by heptane or octane, 20 grams. The resulting coating solution was applied to a substrate comprised of a vacuum deposited titanium layer on a polyethylene terephthalate film using a 1 mil gap Bird applicator. The coating resulting was oven dried for between 1 and 10 minutes at 135° C. To this coating or layer was applied a 0.5 weight percent solution of a polyester 49,000 adhesive layer, about 0.5 micron in thickness, which polyester was obtained from E. I. DuPont deNemours in methylene chloride using a 1-mil gap Bird applicator and the resultant film or layer was dried between 1 and 10 minutes with 3 minutes preferred at 135° C. To this layer was applied a photogenerator layer of a 4.0 weight percent solids toluene dispersion of hydroxygallium phthalocyanine with a 11,000 molecular weight $M_w$ binder polymer of polystyrene-block-polyvinylpyridine. The dispersion was generated by roll-milling 1.33 grams of hydroxygallium phthalocyanine with 1.5 grams of the above polystyrene polyvinyl pyridine block copolymer at 7 percent solids in toluene for 24 hours with steel shot. The resulting dispersion was then diluted to 4 percent solids and applied using a 0.5 mil gap Bird applicator. The resulting binder-photogenerator layer, about 1 micron in thickness, was then oven dried at 135° C. for 5 minutes. A charge transport layer solution was then prepared by dissolving TBD (N,N'-diphenyl-N,N'-bis(methylphenyl)-1,1-biphenyl-4,4'-diamine, 1.2 grams) in MAKROLON® polycarbonate (1.2 grams) in 13.45 grams of methylene chloride. This solution was then applied to the photogenerating layer using an 8 mil gap Bird applicator, and the layer was oven dried by ramping the temperature from 40° C. to 100° C. over 30 minutes. The resultant dried charge transport layer film was of a thickness of 25 microns. The photoresponsive device (photoreceptor) was analyzed using a cyclic scanner test fixture as illustrated hereinbefore, and the results are summarized hereinafter.

Examples of variables selected for these devices are the thickness of the undercoat layer and the time/temperature drying of the gamma-aminopropyltriethoxysilane layer. The time/temperature are indicated in the Table that follows and when not indicated the drying time/temperature was 3 to 5 minutes at 135° C. Another variable was the coating thickness of the γ-APS layer. The γ-APS layer was coated, dried and overcoated again with γ-APS and then dried. This layer was about 500 Angstroms in thickness or designated as a 2× or about 1,000 Angstroms thickness. An additional γ-APS layer and drying step was used to generate a 3× thickness layer, about 1,500 Angstroms (0.15 micron), of the gamma APS.

In the following tables, $V_0$ is the initial charging potential in volts, $V_{dd/sec}$ is the dark decay in volts per second, S is the initial slope of the photo-induced discharge curve (PIDC) in units of ergs/(volts. $cm^2$), Vr is the residual potential after erase in volts, $V_{depl}$ is the depletion voltage (from the charging characteristics) in volts, $V_{cycle\text{-}up}$ is the rise in residual potential in 10,000 cycles, $VI_{3.8}$ is the potential of the PIDC at an exposure of 3.8 ergs/$cm^2$, $E_{1/2}$ is the energy required to discharge 50 percent of the potential and qV20 μC is the potential from the charging characteristics at a charging current of 20 μC (microcoulombs).

| Sample/Description | $V_o$ | $V_{dd/sec}$ | S | Vr | $V_{depl}$ | $V_{cycle\text{-}up}$ | $VI_{3.8}$ | $E_{1/2}$ | qV20 μC |
|---|---|---|---|---|---|---|---|---|---|
| IA: γAPS/49K/HOGaPc/CTL | 798 | 115 | 316 | 25 | 7 | 8 | | 1.35 | 850 |
| IB:γAPS (10 min/135)/49K/HOGaPc/CTL | 797 | 148 | 257 | 65 | 5 | −10 | 115 | 1.65 | 650 |
| IC: γAPS (1 min/135)/49K/HOGaPc/CTL | 799 | 161 | 376 | 23 | 23 | −13 | 72 | 1.19 | 900 |
| ID: γAPS (3 min/135)/49K/HOGaPc/CTL | 798 | 136 | 295 | 21 | −19 | 6 | 65 | 1.44 | 800 |
| IE: γAPS/49K/HOGaPc/CTL | 797 | 94 | 284 | 14 | 26 | 0.2 | 67 | 1.49 | 800 |

-continued

| Sample/Description | $V_o$ | $V_{dd/sec}$ | S | Vr | $V_{depl}$ | $V_{cycle-up}$ | $VI_{3.8}$ | $E_{1/2}$ | qV20 μC |
|---|---|---|---|---|---|---|---|---|---|
| IF: γAPS/49K/HOGaPc/CTL | 796 | 80 | 273 | 32 | 38 | −4 | 88 | 1.56 | 850 |
| IG: γAPS/49K/HOGaPc/CTL | 799 | 119 | 272 | 23 | 38 | −5 | 83 | 1.57 | 775 |
| IH: γAPS (thick, 0.75μ)/49K/HOGaPc/CTL | 799 | 115 | 284 | 4 | 20 | −3 | 79 | 1.54 | 800 |
| II: γAPS(thin)/49K/HOGaPc/CTL | 799 | 126 | 322 | −2 | −25 | −0.7 | 40 | 1.32 | 800 |
| IJ: γAPS/49K/HOGaPc/CTL | 800 | 64 | 367 | −5 | −7.1 | −0.3 | 21 | 1.15 | 975 |
| IK: γAPS/HOGaPc/CTL | 798 | 56 | 304 | 6 | 8 | −7 | 65 | 1.43 | 900 |
| IL: γAPS/(3 min/135)/49K/HOGaPc/CTL | 798 | 203 | 297 | 3 | −10 | −0.4 | 53 | 1.43 | 775 |
| IM: γAPS(1 min/135)/ 49K/HOGaPc/CTL | 798 | 136 | 289 | 10 | 6 | −0.8 | 66 | 1.48 | 750 |
| IN: γAPS (5 min/135)/49K/HOGaPc/CTL | 798 | 109 | 305 | 4 | 12 | −0.8 | 51 | 1.40 | 810 |
| IO: γAPS (10 min/135)/49K/HOGaPc/CTL | 798 | 106 | 337 | 2 | 15 | −1.5 | 45 | 1.27 | 910 |
| IP: γAPS (thick, 2x)/49K/HOGaPc/CTL | 796 | 58 | 318 | 15 | 12 | −0.9 | 55 | 1.34 | 825 |
| IQ: γAPS (thick, 3x)/49K/HOGaPc/CTL | 797 | 51 | 335 | 8 | 124 | −1.7 | 53 | 1.28 | 975 |
| IR: γAPS (thin, 1x)/49K/HOGaPc/CTL | 797 | 64 | 360 | −4 | 126 | 0.8 | 18 | 1.15 | 975 |
| IS: γAPS/49K/HOGaPc/CTL | 799 | 57 | 345 | 12 | 17 | −1 | 35 | 1.23 | 1000 |
| IT: γAPS/49K/HOGaPc/CTL | 800 | 78 | 336 | 1 | 13 | 1.6 | 33 | 1.25 | 850 |
| IU: γAPS/49K/HOGaPc/CTL | 796 | 105 | 423 | −2 | 6 | 0.4 | 13 | 0.98 | 1050 |
| IV: γAPS/49K/HOGaPc/CTL | 804 | 101 | 297 | 19 | −31 | −4.4 | 94 | 1.51 | 800 |
| IW: γAPS/49K/HOGaPc/CTL | 799 | 64 | 253 | 72 | 59 | −7.8 | 141 | 1.73 | 800 |
| IX: γAPS/49K/HOGaPc/CTL | 797 | 38 | 282 | 84 | 78 | 54 | 160 | 1.64 | 1100 |
| IY: γAPS/49K/HOGaPc/CTL | 800 | 116 | 289 | 42 | 47 | −1.4 | | | 825 |
| IZ: γAPS/49K/HOGaPc/CTL | 799 | 51 | 253 | 59 | 79 | −13 | | | 900 |
| IZA: γAPS/49K/HOGaPc/CTL | 798 | 86 | 284 | 14 | 22 | 2 | | | 900 |

CTL—Charge transport layer

49—K—49,000 polyester adhesive layer min—drying time, for example 3 minutes at 135° C.

Thickness of the undercoat layer was 500 Angstroms; 2×, 1,000 Angstroms; or 3×, 1,500 Angstroms.

The electrical properties of an average control sample containing the gamma-aminotriethoxysilane layer with a hydroxygallium phthalocyanine photogenerator was thus determined to be the following: $V_0$=798, $V_{dd/sec}$=98, S=309, Vr=20, $V_{depl}$=26, $V_{cycle-up}$=0, $VI_{3.8}$=66, $E_{1/2}$=1.39, and qV =864.

EXAMPLE II

Hydroxy Polymer Samples and Photoreceptor Preparation

Materials for Undercoat

Poly(2-hydroxyethylacrylate), HEA, catalog number 850, poly(2-hydroxyethylmethacrylate), HEMA, poly(50 percent HEA-HEMA), poly(75 percent HEMA-HEA), poly(4-hydroxybutylacrylate), HBA) were obtained from Scientific Polymer Products, Ontario, N.Y. γ-APS is gamma-aminopropyltriethoxysilane. γ-APMS is gamma-aminopropyltrimethoxysilane.

Photogenerator Dispersions

The above in the form of undercoat layers were overcoated with the following separate photogenerator dispersions, respectively: hydroxygallium phthalocyanine in polystyrene-block-polyvinylpyridine and toluene; chlorogallium phthalocyanine in poly[vinylchloride (86 weight percent)-vinylacetate-1 weight percent maleic acid] and n-butyl acetate; benzimidazole perylene in PCZ polycarbonate obtained from Fuji Xerox in tetrahydrofuran; and trigonal selenium in polyvinylcarbazole and cyclohexanone. The photogenerator dispersions were prepared as follows: (HOGaPc) a 4.0 weight percent solids toluene dispersion of hydroxygallium phthalocyanine was prepared by roll milling hydroxygallium phthalocyanine (1.3 grams) with 11,000 molecular weight binder polymer of polystyrene-block-polyvinylpyridine (1.5 grams) at 7 percent solids in toluene for 24 hours with steel shot, and then the dispersion was diluted to 4 percent solids. The dispersion was applied to a supporting substrate of a metallized polyethylene terephthalate (75 microns in thickness) using a 0.5 mil gap Bird application followed by oven drying for 3 minutes at 135° C. Benzimidazole perylene (2.4 grams), PCZ-200 polycarbonate, and THF (44.65 grams, 50 milliliters) were roll milled for 96 hours with 300 grams of steel shot in a 4 ounce amber bottle. Ten grams of this above dispersion were added to PCZ-200 polycarbonate (2.37 grams) in THF (7.89 grams) and followed by coating with a 1-mil gap Bird applicator, and then drying for 5 minutes at 135° C. Chlorogallium phthalocyanine photogenerating pigment particles (2.5 weight percent) dispersed in 2.5 weight percent poly [vinylchloride (86 weight percent)-vinylacetate-1 weight percent maleic acid] and 95 weight percent n-butyl acetate using a shot mill attritor was prepared, and this dispersion was coated using a 1-mil gap Bird applicator. A 7.5 volume percent dispersion of trigonal selenium was prepared as illustrated in U.S. Pat. No. 5,308,725, the disclosure of which is totally incorporated herein by reference, by adding 8 grams of polyvinylcarbazole and 140 milliliters of a 1 to 1 volume ratio of a mixture of THF and toluene to a 20 ounce bottle. To this were added 8 grams of trigonal selenium and 1,000 grams of ⅛ inch diameter stainless steel shot. This mixture was placed on a roll mill for 96 hours. Subsequently, 50 grams of the resulting slurry were added to a solution of 3.6 grams of polyvinylcarbazole, 20 grams of TBD in 75 milliliters of a 1:1 volume. Ratio of THF and toluene. The resulting slurry was placed on a paint shaker for 10 minutes, coated with a 1 mil gap Bird applicator, and dried for 5 minutes at 135° C.

Photoreceptor Preparation

Three different photoreceptor designs were investigated. In the first, the hydroxy containing polymer at 20 centipoise in ethanol was coated on a flexible titanized MYLAR® substrate, followed by the optional 49,000 adhesive layer, followed by the binder photogenerator layer, followed by the charge transport layer. The procedures for preparation of the coating solution and fabrication of the layer are described in Example I. In the second device, a layer of hydrolyzed gamma-aminotriethoxysilane was coated on top of the hydroxy containing polymer layer, followed by the optional interfacial adhesive layer, followed by the binder-photogenerator layer, and then followed by the charge transport layer. The third photoreceptor design was comprised of the combination of the hydroxy containing polymer with gamma-aminopropyltriethoxysilane and optionally acetic acid (0.3 gram of acetic acid per gram of gamma-aminopropyltriethoxysilane), followed by the optional interfacial 49,000 adhesive layer, followed by the binder-photogenerator layer, and then followed by the charge transport layer. From these experiments the following was determined. The polyhydroxy containing polymer, HEMA, appears satisfactory for 10,000 scans in C zone (15° C., 10 percent relative humidity), but some cycle-up (residual voltage after light erase) sometimes remained after 30,000 scans. This effect was reversed at higher relative humidity and 25° C. One conclusion from this experiment is that water might be involved in the electron transport mechanism. When gamma-aminopropyltriethoxysilane was present, cycle-up does not appear to occur even at 0 percent relative humidity after 50,000 cycles. It is believed gamma-aminopropyltriethoxysilane either prevents oxidation of the hydroxy groups or chemically reduces the oxidized species back to hydroxyl groups. Gamma-aminopropyltriethoxysilane is desirable in the thick undercoat formulations. Moreover, gamma-aminopropyltriethoxysilane promotes adhesion. In the tables below, the designation slash (/) refers to a separate coating layer, whereas a comma (,) refers to a mixture of the reagents used in a single coating step.

EXAMPLE IIA

Poly(2-hydroxyethyl methacrylate) or HEMA

A typical undercoat solution was prepared by adding and reacting 1 gram of γ-aminopropyltriethoxysilane to poly(2-hydroxyethyl methacrylate) [5 grams of a 20 weight percent solids solution in methanol (i.e., 1 gram of HEMA in 4 grams of methanol)]. Glacial acetic acid (0.3 gram) was optionally added and then 6 grams of ethanol were added. The solution was allowed to stand overnight (16 hours) and was then coated on titanized MYLAR® with a 1 mil gap Bird applicator. After heating between 1 and 10 minutes at 135° C., the dried film thickness was approximately 2 microns. A 49,000 adhesive layer was applied as a 0.5 weight percent solids solution in methylene chloride using a 1-mil Bird applicator. Next, a binder photogenerator layer was applied and then the charge transfer layer was applied as described in Example I. The designation S.C. refers to samples prepared with lab size web slot coating equipment obtained from Hirano Company.

The electrical properties of hydroxygallium phthalocyanine photoreceptor devices coated on (1,000 Angstroms in thickness) HEMA without γ-APS and with a separate overcoated layer of hydrolyzed γ-APS solution (as per Example I) are shown below.

| Sample/Description | $V_o$ | $V_{dd/sec}$ | S | Vr | $V_{depl}$ | $V_{cycle\text{-}up}$ | $VI_{3.8}$ | $E_{1/2}$ | qV20 μC |
|---|---|---|---|---|---|---|---|---|---|
| IIAA γAPS/49K/HOGaPc/CTL(control) | 598 | 139 | 266 | 18 | 2 | 0.8 | 38 | 1.19 | 650 |
| IIAB HEMA3μ/HOGaPc/CTL | 600 | 293 | 284 | 14 | −81. | 4 | 29 | 1.11 | 625 |
| IIAC HEMA/HOGaPc/CTL (S.C.) | 798 | 158 | 272 | 29 | 13 | 7 | 73 | 1.54 | 900 |
| IIAD HEMA/γAPS, HOAc/HOGaPc (S.C.) | 800 | 151 | 247 | 36 | 21 | 5 | 91 | 1.7 | 800 |
| IIAE HEMA/γAPS, HOAc/HOGaPc (S.C.) | 800 | 190 | 255 | 27 | 3 | 7 | 80 | 1.64 | 825 |
| Example I Control (average) | 798 | 98 | 309 | 20 | 26 | 0 | 66 | 1.39 | 864 |

The electrical properties of hydroxygallium phthalocyanine photoreceptor devices coated on an undercoat layer of 2 microns in thickness or a thick layer prepared by mixing HEMA with various amounts of γ-APS are shown below.

| Sample/Description | $V_o$ | $V_{dd/sec}$ | S | Vr | $V_{depl}$ | $V_{cycle\text{-}up}$ | $VI_{3.8}$ | $E_{1/2}$ | qV20 μC |
|---|---|---|---|---|---|---|---|---|---|
| IIAF HEMA 1,γAPS1/HOGaPc/CTL | 800 | 209 | 305 | 6 | 8 | 2 | 50 | 1.39 | 850 |
| IIAG HEMA 1,γAPS1.7/HOGaPc/CTL | 800 | 132 | 288 | 10 | 19 | 2 | 59 | 1.47 | 825 |
| IIAH HEMA 1,γAPS2/HOGaPc/CTL | 799 | 139 | 311 | 15 | 27 | 3 | 57 | 1.37 | 900 |
| IIAI HEMA 1,γAPS1.7/HOGaPc/CTL (thick) | 799 | 103 | 346 | 19 | 28 | 4 | 61 | 1.25 | 1100 |
| IIAJ HEMA 1,γAPS1/HOGaPc/CTL (thick) | 800 | 103 | 304 | 10 | 17 | 36 | 56 | 1.4 | 900 |
| IIAK HEMA 1,γAPS2/HOGaPc/CTL (thick) | 799 | 86 | 279 | 11 | 20 | 3 | 72 | 1.53 | 900 |
| IIAL HEMA 1μ,γAPS, HOAc/HOGaPc/CTL(Aged UCL solution) | 599 | 78 | 301 | 18 | 46 | 8 | 39 | 1.08 | 775 |
| IIAM HEMA 2μ,γAPS/HOGaPc/CTL (Aged) | 599 | 102 | 277 | 14 | 40 | 11 | 36 | 1.15 | 750 |
| IIAN HEMA 2μ,γAPS, HOAc/HOGaPc/CTL (fresh) | 598 | 86 | 280 | 15 | 42 | 7 | 37 | 1.15 | 710 |
| IIAO γAPS/49K/HOGaPc/CTL(control) | 598 | 139 | 266 | 18 | 2 | 0.8 | 38 | 1.19 | 650 |
| Example I Control (average) | 798 | 98 | 309 | 20 | 26 | 0 | 66 | 1.39 | 864 |

EXAMPLE IIB

The electrical properties of benzimidazole perylene photoreceptor devices, prepared as above, coated on HEMA without γ-APS (27D), with a separate layer of hydrolyzed γ-APS solution (as per Example I) (27B and D), and when combined γ-APS (14C, 14D, 14G, and 27F) are shown below.

| Sample/Description | $V_o$ | $V_{dd/sec}$ | S | Vr | $V_{depl}$ | $V_{cycle-up}$ | $VI_{3.8}$ | $E_{1/2}$ | qV20 μC |
|---|---|---|---|---|---|---|---|---|---|
| IIBA H.C. γAPS/49K/BZP/CTL | 800 | 31 | 146 | −287 | 125 | 2.2 | 530 | 6.17 | 1050 |
| IIBB γAPS/49K/BZP/CTL | 800 | 38 | 124 | −210 | 37 | | 506 | 5.51 | 1100 |
| IIBC 2μHEMA/ γAPS/49K/BZP/CTL | 799 | 106 | 108 | −134 | 45 | | 486 | 5.04 | 1200 |
| IIBD 3μHEMA/49K/BZP/CTL | 787 | 138 | 100 | −10 | −79 | | 442 | 4.39 | 1100 |
| IIBE HEMA,γAPS,H/49K/BZP/CTL | 794 | 35 | 125 | −285 | 38 | | 509 | 5.63 | 1050 |
| IIBF HEMA, γAPS,H/49K/BZP/CTL(old) | 792 | 73 | 112 | −48 | 66 | | 430 | 4.21 | 1325 |
| IIBG γAPES/49K/BZP/CTL | 794 | 75 | 101 | −80 | 32 | 5.3 | 495 | 5.26 | 1100 |
| IIBH γAPMS/49K/BZP/CTL | 796 | 90 | 88 | −99 | −182 | −0.6 | 534 | 6.1 | 800 |
| IIBI HEMA, γAPMS,H+/49K/BZP/CTL | 793 | 107 | 99 | −32 | 15 | −30 | 471 | 4.79 | 1110 |
| IIBJ HEMA, γAPS,H+/49K/BZP/CTL | 794 | 77 | 101 | −139 | 67 | −13 | 514 | 5.7 | 1200 |

EXAMPLE IIC

The electrical properties of hydroxygallium phthalocyanine photoreceptor devices, prepared as above, coated on an undercoat layer generated by reacting and mixing poly(2-hydroxyethyl acrylate) or HEA with various amounts of γ-APS are shown below.

| Sample/Description | $V_o$ | $V_{dd/sec}$ | S | Vr | $V_{depl}$ | $V_{cycle-up}$ | $VI_{3.8}$ | $E_{1/2}$ | qV20μC |
|---|---|---|---|---|---|---|---|---|---|
| IICA BLS/IFL/HOGaPc/CTL | 800 | 153 | 263 | 0.7 | −20 | 0.4 | 52 | 1.58 | 700 |
| IICB HEA,γAPMS,HOAc/HOGaPc/CTL | 799 | 99 | 345 | 11 | 22 | 2 | 51 | 1.25 | 1000 |
| IICC HEA,γAPMS, HOAc(1'/135)/49K/HOGaPc/CTL | 800 | 360 | 305 | 17 | 12 | −17 | 72 | 1.43 | 700 |
| IICD HEA,γAPMS, HOAc(10'/135)/49K/HOGaPc/CTL | 756 | 240 | 273 | 20 | 23 | −6 | 58 | 1.46 | 700 |
| IICE HEA,γAPMS(10'/135)/HOGaPc/CTL | 801 | 170 | 324 | 2 | −6.1 | −2 | 40 | 1.31 | 900 |
| IICF Hand Coated Control | 798 | 136 | 295 | 21 | −19 | 6 | 65 | 1.44 | 800 |
| IICG HEA,γAPMS, HOAc(1'/135)/49K/HOGaPc/CTL | 796 | 95 | 307 | 38 | 62 | 2 | 79 | 1.39 | 1025 |
| IICH HEA,γAPMS, HOAc(3'/135)/49K/HOGaPc/CTL | 799 | 120 | 295 | 34 | 54 | −2 | 78 | 1.45 | 900 |
| IICI HEA,γAPMS, HOAc(5'/135)/49K/HOGaPc/CTL | 799 | 103 | 287 | 39 | 55 | −0.7 | 89 | 1.5 | 900 |
| IICJ HEA,γAPMS, HOAc(10'/135)/49K/HOGaPc/CTL | 798 | 98 | 295 | 35 | 53 | 5 | 81 | 1.45 | 975 |
| IICK BLS/IFL/HOGaPc/CTL | 798 | 123 | 341 | 10 | 28 | 13 | 40 | 1.24 | 1100 |
| IICL HEA,γAPMS, HOAc(10'/135)/49K/HOGaPc/CTL | 799 | 114 | 305 | 20 | −9 | −1 | 67 | 1.42 | 875 |
| IICM HEA,γAPS, HOAc(10'/135,6d)/49K/HOGaPc/CTL | 799 | 96 | 304 | 9 | 102 | −0.8 | 58 | 1.41 | 910 |

EXAMPLE IID

Poly(4-hydroxybutyl acrylate) (HBA) was obtained as a 29 weight percent solids solution in isopropanol. A coating solution was generated by adding 1 gram of γ-APS to a solution of HBA (1 gram) in isopropanol (3.5 grams) and methanol (6 grams). Glacial acetic acid (0.3 grams) was added and the solution was magnetically stirred for 16 hours. The resulting coating solution was applied to titanized MYLAR® substrate using a 1 mil gap Bird applicator and then was oven dried at 135° C. for 1 minute. To this 2 micron dry coating was applied a 0.5 weight percent solution of 49,000 adhesive in methylene chloride using a one mil gap

EXAMPLE IIC'

The electrical properties of benzimidazole perylene photoreceptor devices, prepared as above, coated on HEA with γ-APS undercoat layers, about 2.5 to about 3 microns in thickness, were as follows.

| Sample/Description | $V_o$ | $V_{dd/sec}$ | S | Vr | $V_{depl}$ | $V_{cycle-up}$ | $VI_{3.8}$ | $E_{1/2}$ | qV20 μC |
|---|---|---|---|---|---|---|---|---|---|
| IIC'A HEA,γAPMS,H+/49K/BZP/CTL | 799 | 51 | 137 | −325 | 41 | −62 | 550 | 6.76 | 1025 |
| IIC'B HEA,γAPS,H+/49K/BZP/CTL | 798 | 76 | 134 | −325 | 57 | 5 | 553 | 6.87 | 1075 |
| IIC'C γAPS/49K/BZP/CTL | 800 | 31 | 146 | −287 | 125 | 2.2 | 530 | 6.17 | 1050 |
| IIC'D HEA,γAPMS,H+/49K/BZP/GTL | 799 | 77 | 149 | −334 | 70 | −9.5 | 551 | 6.84 | 1100 |
| IIC'E HEA,γAPMS,H+/49K/BZP/CTL | 798 | 84 | 114 | −244 | 85 | 4 | 542 | 6.47 | 1225 |
| IIC'F HEA,γAPMS,H+/49K/BZP/CTL | 799 | 50 | 149 | −345 | 66 | −1.5 | 550 | 6.79 | 1025 |
| IIC'G γAPES/49K/BZP/CTL | 794 | 75 | 101 | −80 | 32 | 5.3 | 495 | 5.26 | 1100 |
| IIC'H γAPMS/49K/BZP/CTL | 796 | 90 | 88 | −99 | −182 | −0.6 | 534 | 6.1 | 800 |

Bird applicator and the film was oven dried for 3 minutes at 135° C., resulting in a layer with a thickness of about 1 micron. Hydroxygallium binder generator layer (4 weight percent solids in toluene) was applied using a 0.5 mil gap Bird applicator and the film was dried at 135° C. for 5 minutes, resulting in a thickness of about 0.5 micron. This layer was then coated with a charge transport layer of TBD, reference Example I, (1.2 gram) and MAKROLON® (1.2 gram) in 13.45 grams of methylene chloride using an 8 mil gap Bird applicator. The film was oven-dried by ramping the temperature from about 40° C. to about 100° C. over 30 minutes.

The electrical properties of the hydroxygallium phthalocyanine photoreceptor devices coated on undercoated films of HBA with various amounts of γ-APS were.

| Sample/Description | $V_o$ | $V_{dd/sec}$ | S | Vr | $V_{depl}$ | $V_{cycle-up}$ | $VI_{3.8}$ | $E_{1/2}$ | qV20 μC |
|---|---|---|---|---|---|---|---|---|---|
| IIDA HBA, γAPMS, HOAc/49K/HOGaPc/CTL (1'/135) | 801 | 200 | 263 | 75 | 71 | −15 | 138 | 1.67 | 725 |
| IIDB HBA, γAPMS, HOAc/49K/HOGaPc/CTL (10'/135) | 713 | 201 | 235 | 81 | 51 | −14 | 132 | 1.67 | 650 |
| IIDC HBA/γAPMS/HOGaPc/CTL (10'/135) | 805 | 95 | 327 | 15 | 27 | 2 | 62 | 1.33 | 950 |
| IIDD HBA, γAPMS, HOAc/49K/HOGaPc/CTL (1'/135) | 798 | 43 | 286 | 78 | 90 | −20 | 139 | 1.57 | 1000 |
| IIDE HBA,γAPMS, HOAc/49K/HOGaPc/CTL (3'/135) | 798 | 45 | 270 | 69 | 77 | −17 | 135 | 1.64 | 875 |
| IIDF HBA,γAPMS, HOAc/49K/HOGaPc/CTL (5'/135) | 798 | 54 | 310 | 73 | 87 | −17 | 122 | 1.43 | 975 |
| IIDG HBA,γAPMS, HOAc/49K/HOGaPc/CTL (10'/135) | 797 | 45 | 290 | 69 | 79 | −13 | 121 | 1.51 | 975 |
| IIDH Hand Coated Control | 798 | 136 | 295 | 21 | −19 | 6 | 65 | 1.44 | 800 |
| IIDI HBA/γAPMS/HOGaPc/CTL | 798 | 63 | 308 | 73 | 88 | 5 | 131 | 1.47 | 1050 |
| IIDJH HBA,γAPS, HOAc(10'/135,6d)/49K/HOGaPc/CTL | 798 | 51 | 285 | 65 | 78 | −1 | 119 | 1.54 | 950 |

EXAMPLE IIE

Poly(50/50 mol percent 2-hydroxyethyl methacrylate-2-hydroxyethyl acrylate) (HEMA-HEA) was obtained as a 20 weight percent solids solution in methanol. A coating solution was prepared by adding 1 gram of γ-APS to a solution of HEMA-HEA (1 gram) in methanol (4 grams) and methanol (6 grams). Glacial acetic acid (0.3 gram) was added and the solution was magnetically stirred for 16 hours. The coating solution was applied to titanized MYLAR® substrate, about 75 microns in thickness, using a 1 mil gap Bird applicator and then was oven dried at 135° C. for 1 minute. To the resulting 2 micron dry coating undercoat layer was applied a 0.5 weight percent solution of 49,000 adhesive in methylene chloride using a one mil gap Bird applicator and the film was oven dried for 3 minutes at 135° C. (about 1 micron in thickness). Hydroxygallium binder generator layer (4 weight percent solids in toluene) was applied to the adhesive layer using a 0.5 mil gap Bird applicator and the film was dried at 135° C. for 5 minutes (about 0.7 micron in thickness). There was then applied a charge transport layer of TBD (1.2 gram) and MAKROLON® (1.2 gram) in 13.45 grams of methylene chloride using an 8 mil gap Bird applicator. The film was oven-dried by ramping the temperature from about 40° C. to about 100° C. over 30 minutes. Electrical properties of hydroxygallium phthalocyanine photoreceptor devices coated on HEMA-HEA with various amounts of γ-APS were.

| Sample/Description | $V_o$ | $V_{dd/sec}$ | S | Vr | $V_{depl}$ | $V_{cycle-up}$ | $VI_{3.8}$ | $E_{1/2}$ | qV20 μC |
|---|---|---|---|---|---|---|---|---|---|
| IIEA 50 percent HEMA-HEA/ γAPS/HOGaPc/CTL (MeOH) | 796 | 139 | 288 | 37 | 12 | 8 | | 1.49 | 825 |
| IIEB HEMA-HEA/ γAPS/HOGaPc/CTL (EtOH) | 796 | 81 | 295 | 36 | 16 | 6 | | 1.44 | 900 |
| IIEC HEMA-HEA/ γAPS/HOGaPc/CTL(H2O) | 798 | 76 | 312 | 37 | 40 | 5 | | 1.38 | |
| IIED γAPS/49K/HOGaPc/CTL | 798 | 115 | 316 | 25 | 7 | 8 | | 1.35 | |
| IIEE HEA-HEMA, γAPMS(H2O),HOAc/HOGaPc | 798 | 102 | 264 | 23 | 28 | −0.3 | 77 | 1.59 | 800 |
| IIEF HEA-HEMA, γAPMS(MeOH),HOAc/HOGaPc | 799 | 114 | 255 | 19 | 17 | 2 | 74 | 1.64 | 775 |
| IIEG HEMA-HEA, γAPMS,HOAc/HOGaPc/CTL (MeOH)) | 798 | 152 | 298 | 20 | 40 | −8 | 65 | 1.43 | 900 |
| IIEH HEMA-HEA, γAPMS,HOAc/HOGaPc/CTL (EtOH)) | 797 | 99 | 291 | 24 | 44 | −6 | 74 | 1.47 | 900 |
| IIEI HEMA-HEA, γAPMS,HOAc/HOGaPc/CTL (H2O) | 796 | 77 | 335 | 23 | 40 | −2 | 66 | 1.29 | 975 |
| γAPS/HOAc/49K/HOGaPc/CTL | 797 | 94 | 284 | 14 | 26 | 0.2 | 67 | 1.49 | 800 |
| Control (Example I) | 798 | 98 | 309 | 2 | | | | | |
| -13 | 514 | 5.7 | 1200 | | | | | | |

Some conclusions interpreted from the above tables are as follows: Vr relates to the concentration of hydroxy groups on the polymer such that HEA (8.7 mmol OH/g, Vr=10 v), HEMA (7.75 mmol OH/g, Vr=10 v), PVBA (7.5 mmol OH/g, Vr=19 v), and HBA (6.99 mmol OH/g, Vr>65 v). All of the materials performed better with γ-APS than without, and a separate layer of hydrolyzed γ-APS could also be useful in improving the electrical properties of the photoreceptor devices. For HEA with γ-APS and acetic acid, excellent electricals were obtained with HOGaPc, BZP, and also for trigonal selenium generator layers. No depletions were apparent with BZP as was found with γ-APS alone. Water was not involved in the electron transfer because no cycle-up took place after 10,000 cycles at 0 percent relative humidity in a motionless scanner employing contact charging. HEMA by itself was not acceptable as an undercoat layer primarily because it cycled-up and had high dark decay in addition to suffering from humidity sensitivity in A zone (80° F., 80 percent relative humidity). For a mixture of HEMA with γ-APS and acetic acid, excellent electricals were obtained with HOGaPc, BZP, and trigonal selenium. For HBA with γ-APS and acetic acid, good electricals were obtained with HOGaPc, but not as good as HEMA or HEA, due to high Vr. Water helped in the HBA formulation to lower Vr and improved the performance of the devices.

EXAMPLE III

Other Hydroxy Polymers

Other hydroxy containing polymers that were investigated as under coat layers with hydroxygallium phthalocyanine included polyvinylphenol and Durite, a phenol-formaldehyde resole. The electrical properties of these hydroxygallium phthalocyanine photoreceptors, prepared as above, are summarized below. These polymers possess low concentrations of hydroxy groups and trace contaminants which cause high Vr values.

| Sample/Description | $V_o$ | $V_{dd/sec}$ | S | Vr | $V_{depl}$ | $V_{cycle-up}$ | $VI_{3.8}$ | $E_{½}$ | qV20μc |
|---|---|---|---|---|---|---|---|---|---|
| IIIA polyvinylphenol (PVP)/ 49K/HOGaPc/CTL | 786 | 226 | 288 | 115 | 52 | 44 | 131 | 1.42 | 950 |
| IIIB PVP, γAPS/49K/HOGaPc/CTL | 794 | 210 | 276 | 85 | 54 | −46 | 108 | 1.5 | 825 |
| IIIC Durite, γAPS/49K/HOGaPc/CTL | 794 | 265 | 297 | 67 | 36 | −38 | 115 | 1.47 | 900 |
| IIID HEMA, γAPS/49K/HOGaPc/CTL | 755 | 176 | 209 | 64 | 23 | −20 | 111 | 1.87 | 610 |
| IIIE γAPS/49K/HOGaPc/CTL | 796 | 131 | 280 | 38 | 232 | −4 | 86 | 1.52 | 900 |
| IIIF HEA, γAPMS (1.8 μ)/HOGaPc/CTL | 798 | 98 | 320 | −3 | 27 | −2 | 54 | 1.36 | 900 |
| IIIG γAPMS/HOGaPc/CTL | 799 | 115 | 284 | 4 | 20 | −3 | 79 | 1.54 | 800 |

EXAMPLE IV

OPC Drum Photoreceptors Made Prepared Chlorogallium Phthalocyanine (ClGaPc) Photogenerator HEMA (12 grams in 48 grams of methanol), 12 grams of γ-APS, and 14 grams of ethanol were stirred for 16 hours and the resultant Brookfield viscosity was 68 cps. More ethanol (22.48 grams) was added and the resultant viscosity was 22.5 cps at about 75° C. The above procedure was repeated, except glacial acetic acid (3.6 grams) was added. The two respective solutions were used to dip coat aluminum drums at pull rates of 350 millimeters/minute. The coatings were oven dried for 40 minutes at 130° C. The thickness of the resulting undercoat dried layer was 2 microns. To the dried undercoat blocking layers was added a charge generator layer containing 2.5 weight percent chlorogallium phthalocyanine pigment particles, 2.5 weight percent polyvinylbutyral film forming polymer, and 95 weight percent cyclohexanone solvent. The coating was applied at a coating bath withdrawal rate of 300 millimeters/minute. After drying in a forced air oven for 15 minutes at 125° C., the charge generating layer had a thickness of 0.2 micron. Then, a PCZ polycarbonate-arylamine of Example I (1 part to 1 part) charge transport layer (at 25 microns dry thickness) was coated on top of the photogenerating layer from a 25 weight percent solids solution in chlorobenzene (20 percent) and THF. Drying was accomplished at 125° C. for 40 minutes. The resultant photoreceptors had the electrical properties summarized below.

| Sample | $V_o$ | Q/A (PIDC) | $V_{dd/sec}$ | dV/dx | $V_{erase}$ | Δ Erase | VL 15 ergs | $V_{deps}$ |
|---|---|---|---|---|---|---|---|---|
| Control (U.S. Pat. 5,449,573) | 524 | 78 | 8 | 148 | 7 | 0 | 12 | 78 |
| IVA HEMA, γAPS, No HOAc | 529 | 73 | 5 | 136 | 9 | 0 | 20 | 35 |
| IVB HEMA, γAPS, HOAc | 527 | 73 | 6 | 135 | 9 | 1 | 20 | 33 |

Other embodiments and modifications of the present invention may occur to those skilled in the art subsequent to a review of the information presented herein; these embodiments and modifications, as well as equivalents thereof, are also included within the scope of this invention.

What is claimed is:

1. A photoconductive imaging member comprised of a supporting substrate, a layer (1) thereover, a photogenerating layer and a charge transport layer, and wherein said layer (1) is generated from a polyhydroxyalkylacrylate and an amino alkyltrialkoxysilane, wherein the polyhydroxyalkylacrylate is a homopolymer.

2. A photoconductive imaging member in accordance with claim 1 wherein alkyl contains from about 1 to about 25 carbon atoms.

3. A photoconductive imaging member in accordance with claim 1 wherein alkyl contains from about 1 to about 4 carbon atoms.

4. A photoconductive imaging member in accordance with claim 1 wherein alkyl contains from about 1 to about 10 carbon atoms.

5. A photoconductive imaging member in accordance with claim 1 wherein alkoxy contains from about 1 to about 25 carbon atoms.

6. A photoconductive imaging member in accordance with claim 1 wherein alkoxy contains from about 1 to about 12 carbon atoms.

7. A photoconductive imaging member in accordance with claim 1 wherein said acrylate is poly(2-hydroxyethylacrylate) poly(2-hydroxyethyl methacrylate), poly(3-hydroxypropyl acrylate), poly(3-hydroxypropyl methacrylate), poly(4-hydroxybutyl acrylate), or poly(4-hydroxybutyl methacrylate).

8. A photoconductive imaging member in accordance with claim 1 wherein the molecular weight $M_n$ of said acrylate is from about 5,000 to about 100,000, and the polydispersity is from about 1 to about 10.

9. A photoconductive imaging member in accordance with claim 1 wherein said silane is an aminopropyltrimethoxysilane.

10. A photoconductive imaging member in accordance with claim 1 wherein said silane is gamma-aminopropyltriethoxysilane.

11. A photoconductive imaging member in accordance with claim 1 wherein said reaction results in a component which contains from about 1 to about 99 percent by weight of said polyhydroxyalkylacrylate, and from about 99 to about 1 weight percent of said amino alkyltrialkoxysilane, and wherein the total of said two components is about 100 percent.

12. A photoconductive imaging member in accordance with claim 1 wherein said reaction results in a component which contains from about 25 to about 75 percent by weight of said polyhydroxyalkylacrylate, and from about 25 to about 75 weight percent of said amino alkyltrialkoxysilane, and wherein the total of said two components is about 100 percent.

13. A photoconductive imaging member in accordance with claim 1 wherein there is selected as said alkyltrialkoxysilane, methyltrimethoxysilane, methyltriethoxysilane, ethyltrimethoxysilane, methyltriethoxysilane, ethyltriethoxysilane, or propyltrimethoxysilane.

14. A photoconductive imaging member in accordance with claim 1 wherein said layer (1) is of a thickness of from about 1 to about 5 microns.

15. A photoconductive imaging member in accordance with claim 1 wherein said layer (1) is of a thickness of from about 1 to about 3 microns.

16. A photoconductive imaging member in accordance with claim 1 comprised in the following sequence of a supporting substrate, said layer (1) functioning as an undercoat layer, an adhesive layer, a photogenerating layer and a charge transport layer.

17. A photoconductive imaging member in accordance with claim 1 further containing an adhesive layer comprised of a polyester with an $M_w$ of about 70,000, and an $M_n$ of about 35,000.

18. A photoconductive imaging member in accordance with claim 17 wherein said alkytrialkoxsilance is selected from the group consisting of methyltrimethoxysilane, methyltriethoxysilance, ethyltrimethoxysilane, ethyltriethoxysilane, and propyltrimethoxysilane.

19. A photoconductive imaging member in accordance with claim 1 wherein the supporting substrate is comprised of a conductive metal substrate.

20. A photoconductive imaging member in accordance with claim 1 wherein the substrate is aluminum, polyethylene terephthalate or titanized polyethylene terephthalate.

21. A photoconductive imaging member in accordance with claim 1 wherein said photogenerator layer is of a thickness of from about 0.05 to about 10 microns.

22. A photoconductive imaging member in accordance with claim 1 wherein said transport layer is of a thickness of from about 10 to about 50 microns.

23. A photoconductive imaging member in accordance with claim 1 wherein the photogenerating layer is comprised of photogenerating pigments dispersed in a resinous binder, and which pigments are selected in an amount of from about 5 percent by weight to about 95 percent by weight.

24. A photoconductive imaging member in accordance with claim 23 wherein the resinous binder is selected from the group consisting of polyesters, polyvinyl butyrals, polycarbonates, polystyrene-b-polyvinyl pyridine, and polyvinyl formals.

25. A photoconductive imaging member in accordance with claim 1 wherein said charge transport layer comprises aryl amine molecules.

26. A photoconductive imaging member in accordance with claim 25 wherein the aryl amines are of the formula

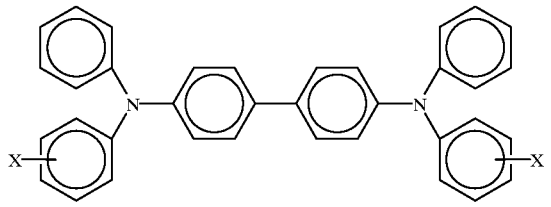

wherein X is selected from the group consisting of alkyl and halogen, and wherein the aryl amine is optionally dispersed in a highly insulating and transparent resinous binder.

27. A photoconductive imaging member in accordance with claim 26 wherein alkyl in the arylamine contains from about 1 to about 10 carbon atoms.

28. A photoconductive imaging member in accordance with claim 26 wherein the alkyl of the aryl amine is methyl, wherein halogen is chloride, and wherein the resinous binder is selected from the group consisting of polycarbonates, polyarylene ether ketones, and polystyrenes.

29. A photoconductive imaging member in accordance with claim 25 wherein the aryl amine is N,N'-diphenyl-N,N-bis(3-methyl phenyl)-1,1'-biphenyl-4,4'-diamine.

30. A photoconductive imaging member in accordance with claim 25 further including an adhesive layer of a polyester with an $M_w$ of about 70,000, and an $M_n$ of about 35,000.

31. A photoconductive imaging member in accordance with claim 1 wherein the photogenerating layer is comprised of metal phthalocyanines, or metal free phthalocyanines.

32. A photoconductive imaging member in accordance with claim 1 wherein the photogenerating layer is comprised of titanyl phthalocyanines, perylenes, hydroxygallium phthalocyanines, trigonal selenium, chlorogallium phthalocyanine, mixtures of chlorogallium phthalocyanine and hydroxygallium phthalocyanine and dimers thereof.

33. A photoconductive imaging member in accordance with claim 1 wherein the photogenerating layer is comprised of Type V hydroxygallium phthalocyanine.

34. A method of imaging which comprises generating an electrostatic latent image on the imaging member of claim 1, developing the latent image, and transferring the developed electrostatic image to a substrate.

35. A photoconductive imaging member comprised of a supporting substrate, thereover a hole blocking layer, and which hole blocking layer is generated from the reaction of a polyhydroxalkacrylate and an amino alkytrialkoxy silane, thereover a photogenerating layer, and thereover a charge transport layer, wherein the polyhydroxyalkylacrylate is a homopolymer.

36. A photoconductive imaging member in accordance with claim 35 wherein said hole blocking layer is of a thickness of from about 0.05 to about 5 microns.

37. A photoconductive imaging member in accordance with claim 35 wherein said amino alkyltrialkoxy silane is gamma-amino alkyltrialkoxy silane.

38. A photoconductive imaging member consisting essentially of a supporting substrate, thereover a hole blocking layer, and which hole blocking layer is generated from the reaction of a polyhydroxyalkylacrylate and an amino alkyltrialkoxy silane, thereover a photogenerating layer, and thereover a charge transport layer, wherein the polyhydroxyalkylacrylate is a homopolymer.

* * * * *